US007111562B2

(12) United States Patent
Nolan

(10) Patent No.: US 7,111,562 B2
(45) Date of Patent: Sep. 26, 2006

(54) CARGO SUPPORT DEVICE

(76) Inventor: Roger Nolan, 1217 Kensington Dr., Seymour, IN (US) 47274

( * ) Notice: Subject to any disclaimer, the term of this patent is extended or adjusted under 35 U.S.C. 154(b) by 0 days.

(21) Appl. No.: 10/616,039

(22) Filed: Jul. 9, 2003

(65) Prior Publication Data

US 2005/0005825 A1 Jan. 13, 2005

(51) Int. Cl.
*B65D 19/00* (2006.01)

(52) U.S. Cl. ..... 108/51.11; 108/55.1; 108/901

(58) Field of Classification Search ..... 108/901, 108/51.11, 55.1, 56.1, 56.3, 57.16, 57.25, 108/57.33; 206/386, 595, 596, 598, 599, 206/600; 248/346.02
See application file for complete search history.

(56) References Cited

U.S. PATENT DOCUMENTS 2,733,884 A * 2/1956 Averill ..... 108/53.1
2,781,184 A * 2/1957 Averill ..... 108/53.5
3,133,511 A * 5/1964 Phillips ..... 108/55.1
3,276,808 A * 10/1966 Scaramuzzi ..... 294/67.4
3,677,201 A * 7/1972 Chadbourne ..... 108/57.33
4,292,900 A * 10/1981 Bula ..... 108/57.31
5,676,064 A * 10/1997 Shuert ..... 108/57.25

FOREIGN PATENT DOCUMENTS

DE 296 10 010 * 8/1996
GB 1517521 * 7/1978 ..... 108/51.11

* cited by examiner

*Primary Examiner*—Janet M. Wilkens
(74) *Attorney, Agent, or Firm*—Stoll Keenon Ogden, PLLC

(57) ABSTRACT

A cargo support device in the form of a pallet or a container includes a platform having a cargo support surface, at least one base member for ground support projecting from the platform, the at least one base member having a curved recess formed therein for external access thereto, the curved recess being defined by walls extending into the base member and defining a positioning surface, a receiving surface and a lifting surface.

16 Claims, 6 Drawing Sheets

CARGO SUPPORT DEVICE

BACKGROUND OF THE INVENTION

The present invention relates broadly to cargo pallets, collapsible containers, and fixed wall containers and, more particularly, to a molded cargo support device having curved recesses formed therein to accept lifting implements.

When transporting cargo, such as food and other supplies for shipboard, industrial or commercial use, it is common practice to stack the cargo on pallets or within standard containers that are made of wood or other suitable material. Unless specifically stated otherwise herein, with respect to the present invention, the terms pallet and container are generally interchangeable, as the present invention has application with both pallets and containers, both collapsible and fixed-wall. Therefore, for clarity, the term "pallet" will be employed herein and should be generally understood to encompass both pallets and pallet boxes, also known as containers, both collapsible and fixed-wall, and with distinctions being made when necessary.

When cargo loaded onto the pallet must be lifted, such as when loading it onto a ship, or vehicle bed, a crane will usually be used to lift the pallet. The interface between the pallet and a crane hook can include straps, chains, cables, round bars, tubes or combinations thereof for pallet engagement.

Such a wooden pallet is illustrated in FIG. 6, labeled prior art, which depicts a cross section of a wooden pallet 50 that includes top pallet planks 52, bottom pallet planks 54 and joiner boards 56. The way the joiner boards 56 are placed intermediate the top and bottom pallet planks 52, 54, creates a cavity 58 at the end of the pallet 50. Therefore, one or more of the various lifting devices described above may be fitted within the cavities and the pallet raised by the crane. When the wood pallets and associated corrugated boxes are empty, they are generally ground up and discarded at sea.

In order to eliminate this waste, it would be desirable to provide a pallet that is formed from polymer material which may be reused. Such reusable cargo support devices should be compatible with wooden pallets, thereby giving rise to several requirements for the reusable pallet. First, the reusable cargo support device should have the ability to be handled in the same manner that the wooden pallets are handled. They also need to work with the wooden pallets during handling.

One method of cargo handling involves the use of a "straddle truck." The straddle truck has a body supported well off the ground by elongate legs to define a cargo handling space under the body and between the legs. The straddle truck also includes two generally L-shaped arms that project down from the truck body into the cargo handling space. The arms are laterally movable for pallet gripping, and vertically movable for pallet lifting.

The straddle truck driver sits about ten feet off the ground and the entire truck generally has enough height from the ground up to the truck frame to clear a two-high stack of 39 inch tall containers or pallets, or to accommodate a 40" container and 26" container, stacked. Arms of the straddle truck are laterally displaceable from a disengaged position to a position wherein horizontally projecting members projecting from the arms engage the cavities 58 in the pallets. Accordingly, any substitute would necessarily have to provide some form of spacing for straddle truck engagement.

Once the straddle truck delivers the pallets to the dock, the pallets are hoisted onto the supply ship decks or on vehicle beds. They can be hoisted using slings, cables or steel bars and straps, accommodated by the cavity 58 in the wooden pallet 50.

The pallets are also used to get supplies from a supply ship to another ship during underway replenishment. When this occurs, the transfer at sea can be done using different methods. One method includes the ships moving side by side. There, a cable system is erected between the ships and the goods are transferred via high line using the cable system. Another way is to use helicopters to move the cargo from one ship to another. Once again, straps, slings or other lifting elements are provided to move the pallet between ships on the high line or via helicopter, with the lifting elements engaging the cavities in the pallets. All such devices, including the straddle truck engaging members, configured for engaging a cargo support device for lifting may be collectively referred to herein as "lifting support implements". The use of this term is for clarity and is not intended to limit the present invention in any way.

Accordingly, there exists a need for a usable cargo support device that can be moved in the manner of a wooden pallet and can work freely with the same systems as a wooden pallet, with or without wooden pallets present.

SUMMARY OF THE INVENTION

It is accordingly an object of the present invention to provide a cargo support device such as a cargo pallet, collapsible container, fixed wall container and the like that can be easily rigged for loading by a variety of loading methods.

It is another object of the present invention to provide such a cargo support device that is molded from a polymer.

It is another object of the present invention to provide such a cargo support device that will align with another like cargo support devices for stacking.

To those ends, a cargo support device includes a platform having a cargo support surface; at least one base member for ground support projecting from the platform, with the at least one base member having a curved recess formed therein for external access thereto by lifting support implements. The curved recess is defined by walls extending into the base member and defining a positioning surface, a receiving surface and a lifting surface.

Preferably, the positioning surface is formed by a sloping wall portion of the base member, while the receiving surface is formed by a concave wall portion of the base member. Further, the concave wall portion may be formed as a smooth curve having a substantially constant radius. It is preferred that the lifting surface is formed as a substantially horizontal wall portion of the base member.

Preferentially, the cargo support device includes a plurality of base members configured with the curved recesses formed in general alignment for substantially simultaneously receiving lifting support implements. It is preferred that the base members are formed in a symmetrical relationship along the platform.

It is further preferred that the cargo support device is molded using a polymer and is formed symmetrically in a manner defining four substantially identical corner structures including four substantially identical base members.

The present invention may be described in greater detail as a cargo support device formed as a pallet including a platform having a cargo support surface, the platform being a four sided planar member forming the cargo support surface with a plurality of base members for ground support projecting from the platform. Each base member has a curved recess formed therein for external access thereto, and said platform is configured with the curved recesses formed in general alignment for substantially simultaneously receiving lifting support implements. Each curved recess is defined by a sloping wall portion extending into the base member from a first vertical displacement to a second vertical displacement, the second vertical displacement being closer to the platform than the first vertical displacement, a receiving surface formed by a concave wall portion of the base member and a lifting surface formed as a substantially horizontal wall portion of the base member.

It is preferred that the concave wall portion be formed as a smooth curve having a substantially constant radius.

Preferably, the base members are formed in a symmetrical relationship along the platform. Further, the cargo support device is preferably molded using a polymer and is formed symmetrically in a manner defining four substantially identical corner structures including four substantially identical base members.

The present invention is equally adaptable whether the support device in question is a pallet, as discussed in the foregoing, or a container as described in the following paragraphs. According to a second preferred embodiment of the present invention, a cargo support device is formed as a pallet box or container and includes a platform having a cargo support surface; a plurality of walls projecting outwardly from the platform; and at least one base member for ground support projecting from the platform in a disposition substantially opposing the walls. The at least one base member has a curved recess formed therein for external access thereto by lifting support implements. The curved recess are defined by walls extending into the base member and defining a positioning surface, a receiving surface and a lifting surface.

Preferably, the positioning surface is formed by a sloping wall portion of the base member, while the receiving surface is formed by a concave wall portion of the base member. It is preferred that the concave wall portion is formed as a smooth curve having a substantially constant radius. Preferentially, the lifting surface is formed as a substantially horizontal wall portion of the base member.

It is preferred that the platform is a four sided planar member forming the cargo support surface with the walls projecting outwardly at an angle of about 90 degrees therewith, the walls including two opposing first walls and two opposing second walls, and wherein the base members are formed in alignment with the first walls.

Further, the cargo support device may be molded using a polymer and is formed symmetrically in a manner defining four substantially identical corner structures including four substantially identical base members.

The present cargo container may be described in greater detail as a cargo support device formed as a container and including a platform having a cargo support surface. A plurality of walls project outwardly from the platform, with the platform being a four-sided planar member forming the cargo support surface with the walls projecting outwardly at an angle of about 90 degrees therewith. The walls include two opposing first walls and two opposing second walls. A plurality of base members for ground support project from the platform in a disposition substantially opposing the walls, with each base member being formed in alignment with the first walls and having a curved recess formed therein for external access thereto. The base members are configured with the curved recesses formed in general alignment for substantially simultaneously receiving lifting support implements. Each curved recess is defined by a sloping wall portion extending into the base member from a first vertical displacement to a second vertical displacement, the second vertical displacement being closer to the platform than the first vertical displacement, a receiving surface formed by a concave wall portion of the base member and a lifting surface formed as a substantially horizontal wall portion of the base member.

Preferably, the concave wall portion is formed as a smooth curve having a substantially constant radius.

It is further preferred that the cargo support device is molded using a polymer and is formed symmetrically in a manner defining four substantially identical corner structures including four substantially identical base members.

By the above, the present invention provides a reuseable pallet, or container formed with consistently sized, functionally effective base walls to enhance the ability of lifting implements to find purchase on said pallet or container.

DESCRIPTION OF THE PREFERRED EMBODIMENT

Figure 1:
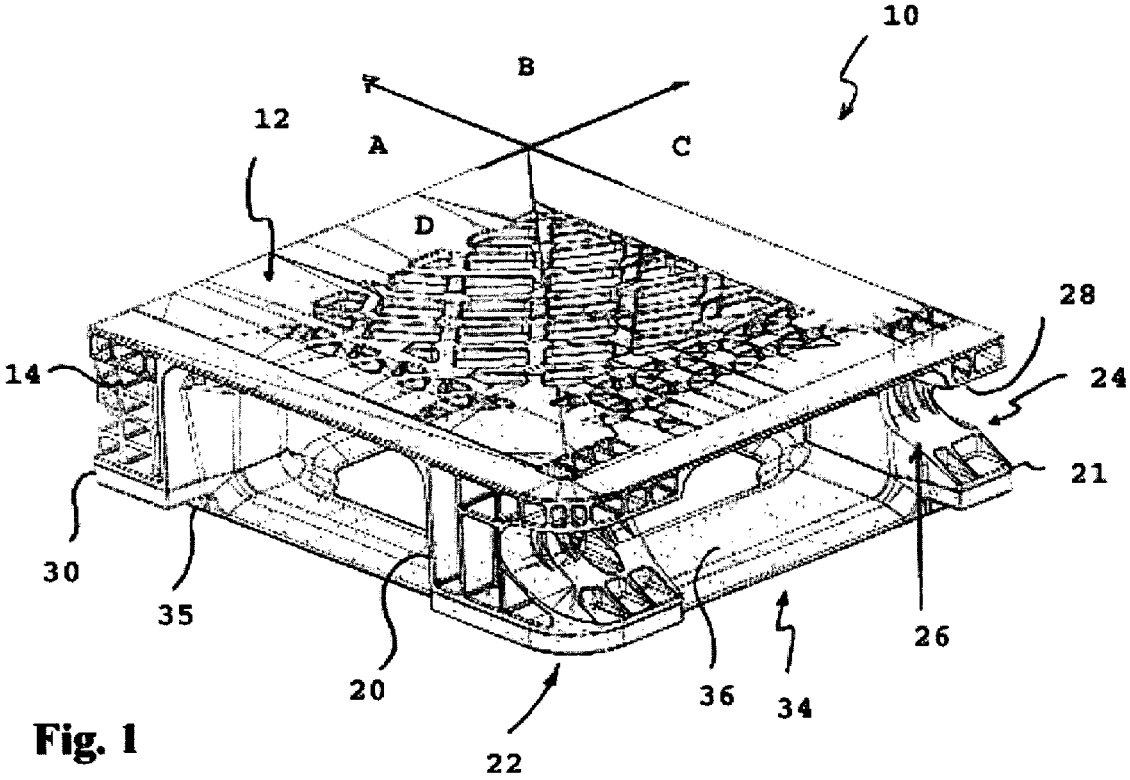
FIG. 1 is a perspective view of a cargo support device formed as a pallet according to one preferred embodiment of the present invention.

Turning now to the drawings, and, more particularly, to FIG. 1, a cargo support device is illustrated generally at 10. At the outset, it should be noted that while the present cargo support device is depicted in FIG. 1 as an open deck pallet, walls can be supplemented and a top affixed to form a closed deck storage container, as seen in FIGS. 2–5. It should be noted that in FIGS. 2–5, the sidewalls have been abbreviated for clarity. Certain predetermined heights are available for closed deck containers, including 25 inches, 29 inches, 34 inches, 39 inches, 42 inches, 47 inches and 50 inches. The foregoing is for informational purposes only, and the present invention is unaffected by any size container walls. Whether an open deck pallet or a closed deck container, the present invention is equally applicable to both structures.

Figure 2:
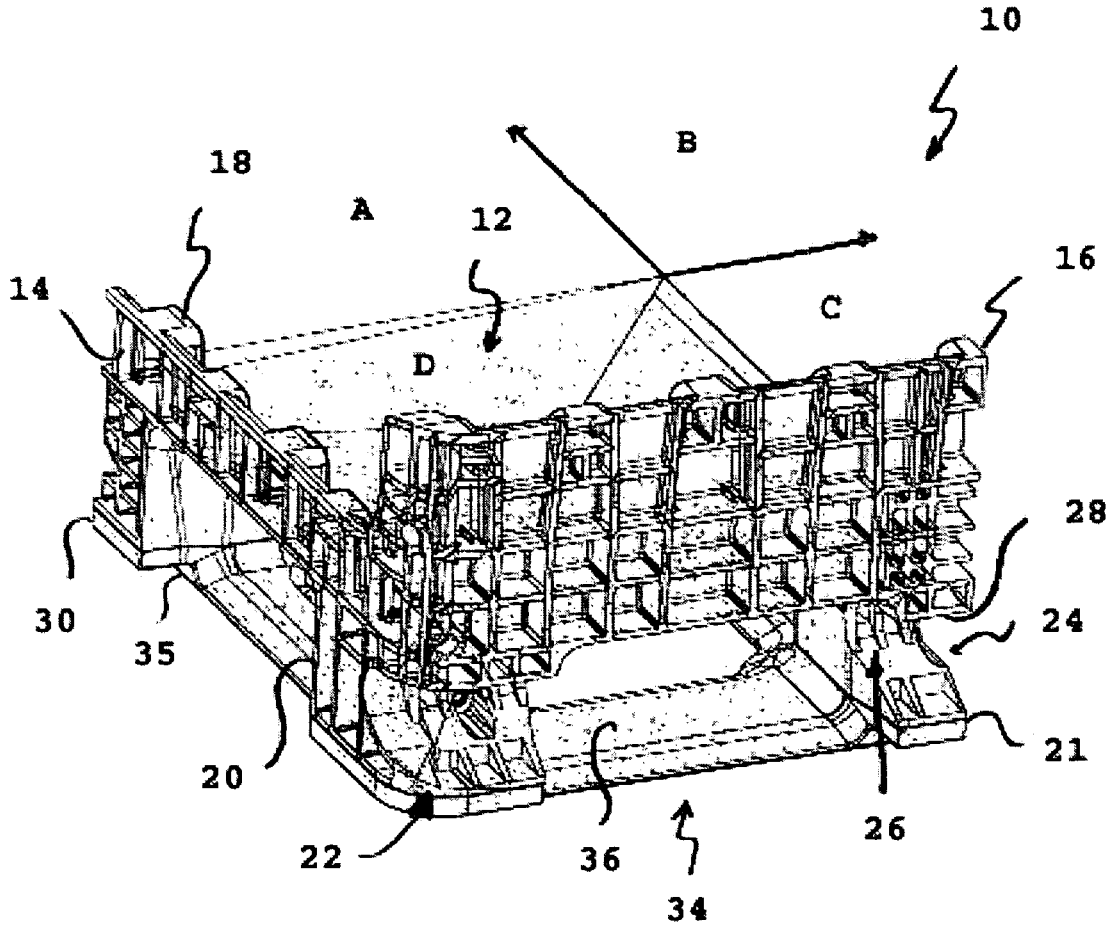
FIG. 2 is a perspective view of a cargo support device illustrated in FIG. 1.

The preferred manner of constructing the cargo support device 10 is by molding from polymer material, but other suitable material may be used, such as aluminum. An additional feature of such pallets is there is no need to certify treatment for Nematodes, as is required of wooden pallets in some foreign countries. In that regard, as will be appreciated by those skilled in the art, the cargo storage device 10 is depicted in the drawings as one symmetric part of a four part whole, i.e. as one quadrant of a four-quadrant cargo support device 10. FIGS. 1 and 2 illustrate the single quadrant D such that the remaining quadrants are symmetrical with respect to the illustrated portion of the cargo support device 10. Other like structures appear at positions A, B, and C in FIG. 1 to provide a single, one piece, molded cargo support device. Additionally, and as will be appreciated by those skilled in the art, the molded structure of the cargo support device 10 includes a multiplicity of strengthening ribs 14.

With renewed reference to FIG. 1, the present open deck cargo support device 10 includes a generally planar platform 12, defining a cargo support surface. Two base members 20, 21 are formed to project from the platform adjacent to and oppositely from the first wall 16, including a corner base member 20 and an inner base member 21. As stated before, FIGS. 1 and 2 illustrate one quadrant D of the entire cargo support device 10. Therefore, it will be apparent that the base members 20, 21 number six, and occur in two rows of three along opposing sides of the cargo support device 10, with each row including two corner base members 20 and one inner base member 21. The base members 20, 21 each include a planar bottom surface. The base members 20, 21 also each include a curved recess 22 formed therein for engagement with lifting devices. The curved recess 22 will be discussed in greater detail hereinafter.

A closed deck container is illustrated in FIG. 2. There, a first end wall 16 projects upwardly from the platform 12 at an approximate 90 degree angle. A second, side wall 18 projects upwardly from a side of the platform 12 adjacent to and integral with the first wall 16. On a complete four-quadrant platform, four walls project upwardly from the platform to form the closed deck design. These walls may be non-sequential folding walls, sequential folding walls or fixed walls. These adjacent container walls 16, 18 hold necessary hinge line configurations that make attaching the sidewalls to the platform possible and allow for them to be collapsed when cargo has been removed and the containers are ready for storage while empty.

Figure 3:
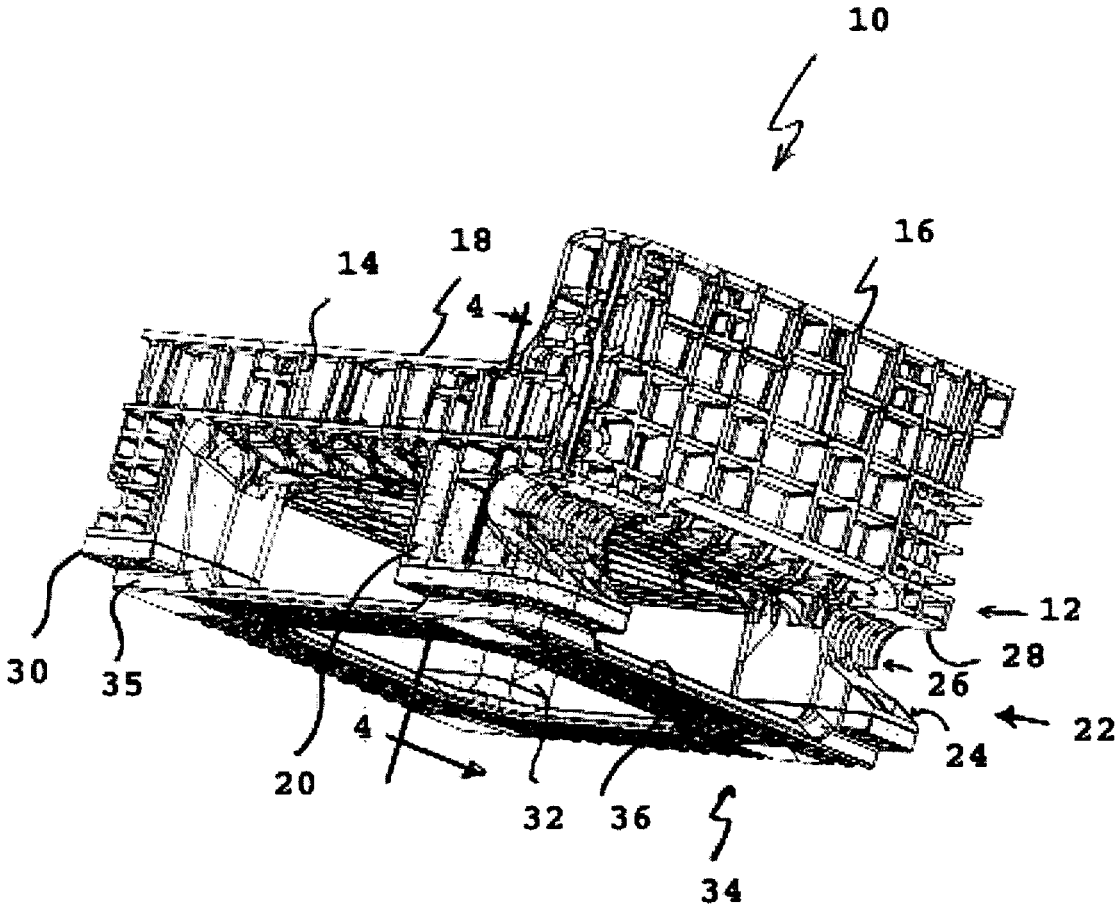
FIG. 3 is a perspective view of the cargo support device illustrated in FIG. 1 from a different viewpoint.

With reference to FIG. 3, a plurality of legs 30, 32 projects outwardly from the platform 12 in a generally parallel relationship with the base members 20, 21. The legs 30 are disposed intermediate opposing base members 20,21 in a symmetrical manner such that along the side of the cargo support device 10 with the shorter side walls, 18, one leg 30 projects from the midpoint between two corner base members 20. Another leg 30 is present on the opposite side of the cargo storage device 10, at the midpoint between the two remaining corner base members 20. A third leg 32 projects outwardly from the center of the cargo support device 10, at the intersection of all four quadrants A, B, C, D. The legs 30, 32 are also formed with planar bottom portions for ground support in concert with the base members 20, 21.

Figure 4:
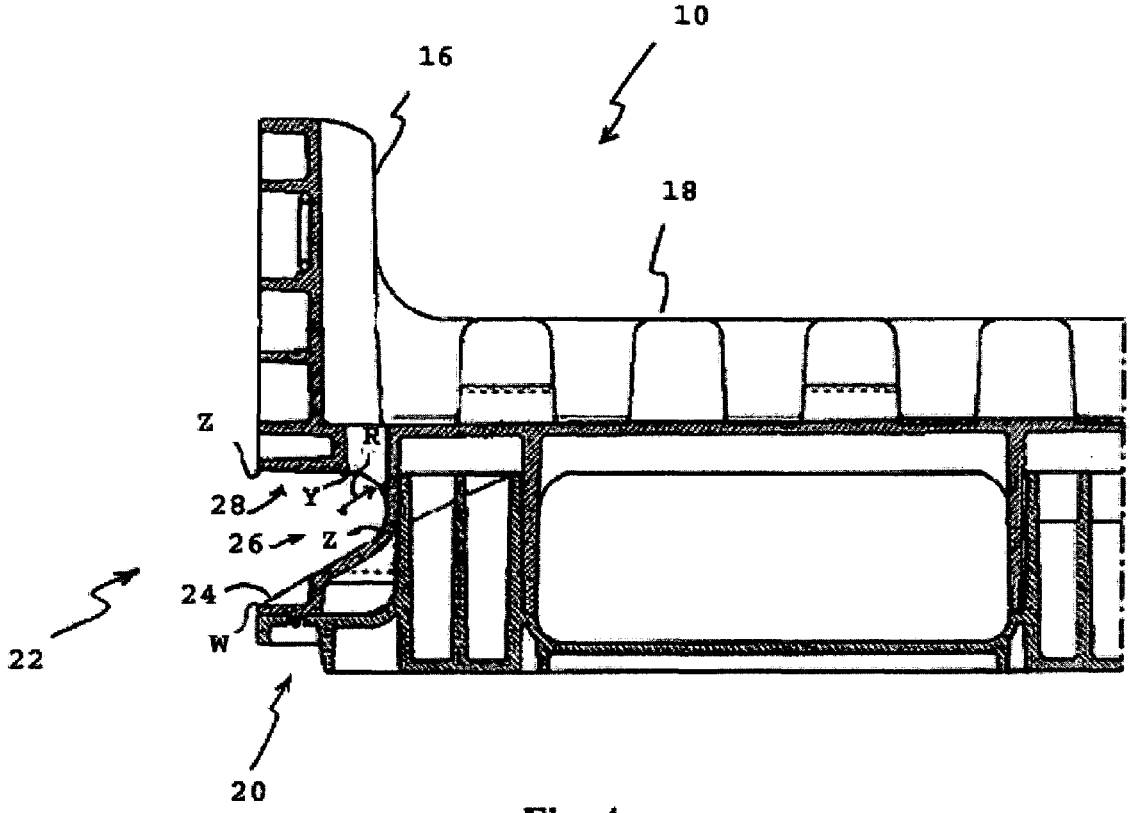
FIG. 4 is a side cutaway view of the cargo support device illustrated in FIG. 1, taken along line 4—4 in FIG. 3.
Figure 5:
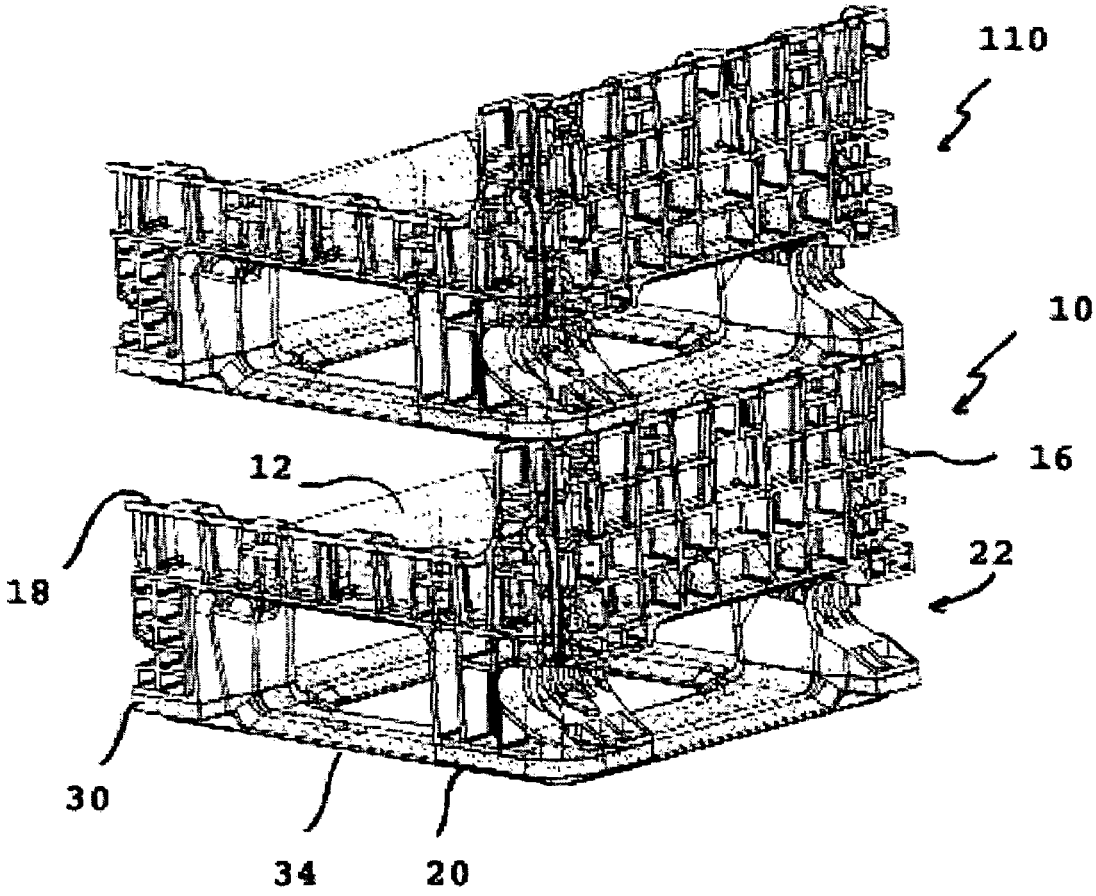
FIG. 5 is a perspective view of two cargo support devices as illustrated in FIG. 1, in a stacked relationship.
Figure 6:
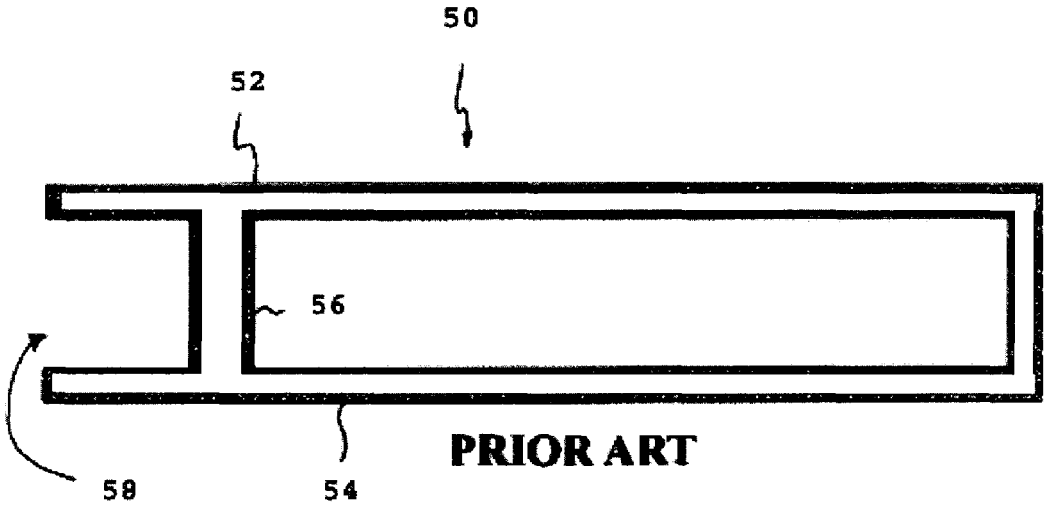
FIG. 6 is a side view of a prior cargo support device and is labeled as such.

An alignment member 34 is formed as four, generally planar elongate relatively thin members 36 extending from a corner base member to an inner base member to the center leg, to an outer leg, and back to the outer base member in a manner that is generally parallel with the platform 12. An alignment member 34 is present in all four quadrants A, B, C, D. The alignment member 34 provides the actual ground contact surface and is also used in stacking like cargo support devices 10, 110, as seen in FIG. 4. The alignment member 34 forms a flange 35 around the lowermost portion of the cargo support device 10. As seen in FIG. 5, the flange 35 of the alignment member 34 of an upper cargo support device 110 is used to engage the upper portion of the end walls 16 of a lower cargo support device 10 to align the upper cargo support device 110 in a stack with the lower cargo support device 10.

Referring now to FIGS. 1–4, it can be seen that the base members 20, 21 each include with a curved recess 22 formed therein for accepting and positioning lifting support implements in accordance with the present invention. Each curved recess 22 extends from an outer surface of the base members 20, 21 inwardly toward the legs 30, 32. Since there are six base members 20, 21, three along each opposing side, there will be six curved recesses 22, with two corner base members 20 and one inner base member 21 along each opposing side.

The curved recesses 22 are formed in the base members 20, 21 with a unique configuration providing enhanced functionality for the cargo support device 10. Each curved recess 22 is generally the same size. As discussed above, due to the symmetrical nature of the cargo storage device 10, only one quadrant D of the device is illustrated. Therefore, the inner base members 21 are illustrated at one half the width of an actual inner base member 21 as seen in FIGS. 1 and 2.

Returning now to FIG. 4, a cross section of the cargo support device 10 is illustrated with the cross section being taken through lines 4—4 in FIG. 3. The curved recess 22 includes three distinct surfaces including an sloped surface 24 for positioning lifting support implements, a concave surface 26 for receiving lifting support implements and a generally horizontal lifting surface 28 for operational engagement with the lifting support implements. The concave surface 26 can be a smooth curve having a substantially constant radius. Starting at origin point W, indicated at the lowermost portion of the curved recess 22 at the outer wall of the base member 20, the sloped surface 24 extends upwardly and inwardly from the origin W to a point X. It should be noted that the term "upwardly" refers to the increase in vertical displacement of the wall forming the curved recess from point W to point X with the vertical displacement being greater at point X than point W. The term "inwardly" refers to an increasing horizontal displacement from external walls of a base member 20, 21 toward a centerline of the platform 12. Further, the present cargo support device 10 includes a single orientation during proper use, i.e. with the alignment member 34, the base members 20, 21 and legs 30, 32 supporting the device 10 either on the ground or in a stacked relationship with the end walls 16 and the side walls 18 projecting vertically. Therefore, the term "upwardly" is used with respect to a properly oriented cargo support device 10.

The second, concave surface 26 extends from point X to point Y through an approximately 180° sweep having a substantially constant radius R. The lifting surface 28 is substantially horizontal and extends between point Y and point Z at the outer surface of the end wall 16 of the cargo support device 10. The base members 20, 21 are aligned such that the curved recesses are in general alignment for receiving lifting support implements. As will be discussed in greater detail hereinafter the specific configuration of the curved recesses 22 enhances the ability of users to lift the cargo support device 10 or a stack of cargo support devices 10, 110 as seen in FIG. 5.

With continued reference to FIG. 5, a second cargo support device 110 is illustrated in a mated relationship with a lower, similar cargo support device 10. It will be appreciated by those skilled in the use of such cargo support devices that the lowermost cargo support device 10 will have lifting support implements attached thereto.

In operation, the cargo support device 10 of the present invention may be loaded with cargo, such as foodstuffs, ammunition and other supplies required for shipboard use. Virtually any product may be carried by the cargo support device 10, with limits defined as to size and weight. It should be noted that the following discussions, for illustrative purposes, treat the present cargo support device 10 as a device that is used for moving supplies to a ship, vehicular bed or any cargo transport apparatus or device. This in no way limits the present invention to dockside or shipboard use and it will be appreciated by those skilled in the art that the cargo support device 10 has utility beyond its function as a cargo pallet or cargo container for delivering goods to a ship.

In order to lift one or more cargo support devices 10 for movement on the dock, a so-called "straddle truck" may be used. The straddle truck includes four legs projecting downwardly from a central backbone to define a cargo space directly underneath the backbone and intermediate the legs. Gripping members move inwardly and outwardly toward the center line of a cargo support device 10 disposed in the cargo space.

Once a cargo support device 10 is engaged by the straddle truck, the cargo support device 10 may be lifted slightly, and then moved about using the straddle truck. The gripping members of the straddle truck may easily engage curved recesses 22, and lift the cargo support device 10 by contact with the horizontal lifting surface 28 of the curved recess 22. Once the loaded cargo support devices 10 appear on a dock, they must be loaded onto a ship by a crane or else the ships crew will have to move the cargo one box at a time along a human chain to get the boxed goods to the respective departments. Use of a crane is preferable.

In order to lift the cargo support devices, a common method is to provide two straps, chains, cables, tubes, round bars or other lifting support implements that are lifted by straps at either end of the device 10, with the straps engaging the crane hook. The lifting support implements engage the upwardly sloped surface 24 of the curved recess 22 and are directed thereby onto the concave receiving surface 26 with a substantially constant radius. If the lifting support implements include rods or bars, the rods or bars may fit snuggly in abutment with the concave surface 26 of the curved recess 22 and the horizontal lifting surface 28 provides a lifting surface and extends the terminus of the concave surface 26 . Straps may be used on either end of the lifting support implements to pick up the cargo storage devices 10 in accordance with the present invention.

By the above, it can be seen that the present invention provides a sturdy, virtually indestructible cargo support device that is reusable and is provided strength due to its wall, base member, and leg configuration. The present invention enhances the ability to move loaded cargo storage devices 10 using a crane or other lifting device, and provides judicious use of resources by being reuseable.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

I claim:

1. A cargo support device comprising a platform having a cargo support surface; at least one base member for ground support projecting from said platform, said at least one base member having a curved recess formed therein for external access thereto by lifting support implements, said curved recess being defined by a sloping wall portion extending into said base member, a receiving surface formed by a concave wall portion of said base member and a lifting surface formed as a substantially horizontal wall portion of said base member.

2. A cargo support device according to claim 1 wherein said concave wall portion is formed as a smooth curve having a substantially constant radius.

3. A cargo support device according to claim 1 wherein said cargo support device includes a plurality of base members configured with said curved recesses formed in general alignment for substantially simultaneously receiving lifting support implements.

4. A cargo support device according to claim 3 wherein said base members are formed in a symmetrical relationship along said platform.

5. A cargo support device according to claim 1 wherein said cargo support device is molded using a polymer and is formed symmetrically in a manner defining four substantially identical corner structures including four substantially identical base members.

6. A cargo support device comprising a platform having a cargo support surface, said platform being a four sided planar member forming said cargo support surface; a plurality of base members for ground support projecting from said platform, each said base member having a curved recess formed therein for external access thereto, and being configured with said curved recesses formed in general alignment for substantially simultaneously receiving lifting support implements; each said curved recess being defined by a sloping wall portion extending into said base member from a first vertical displacement to a second vertical displacement, said second vertical displacement being closer to said platform than said first vertical displacement, a receiving surface formed by a concave wall portion of said base member and a lifting surface formed as a substantially horizontal wall portion of said base member.

7. A cargo support device according to claim 6 wherein said concave wall portion is formed as a smooth curve having a substantially constant radius.

8. A cargo support device according to claim 6 wherein said base members are formed in a symmetrical relationship along said platform.

9. A cargo support device according to claim 6 wherein said cargo support device is molded using a polymer and is formed symmetrically in a manner defining four substantially identical corner structures including four substantially identical base members.

10. A cargo support device formed as a container and comprising a platform having a cargo support surface; a plurality of walls projecting outwardly from said platform; at least one base member for ground support projecting from said platform, in a disposition substantially opposing said walls, said at least one base member having a curved recess formed therein for external access thereto by lifting support implements, said curved recess being defined by a sloping wall portion extending into said base member, a receiving surface formed by a concave wall portion of said base member and a lifting surface formed as a substantially horizontal wall portion of said base member.

11. A cargo support device according to claim 10 wherein said concave wall portion is formed as a smooth curve having a substantially constant radius.

12. A cargo support device according to claim 10 wherein said platform is a four sided planar member forming said cargo support surface with said walls projecting outwardly at an angle of about 90 degrees therewith, said walls including two opposing first walls and two opposing second walls, and wherein said base members are formed in alignment with said first walls.

13. A cargo support device according to claim 10 wherein said cargo support device is molded using a polymer and is formed symmetrically in a manner defining four substantially identical corner structures including four substantially identical base members.

14. A cargo support device formed as a container and comprising a platform having a cargo support surface; a plurality of walls projecting outwardly from said platform, said platform being a four-sided planar member forming said cargo support surface with said walls projecting outwardly at an angle of about 90 degrees therewith, said walls including two opposing first walls and two opposing second walls; a plurality of base members for ground support projecting from said platform in a disposition substantially opposing said walls, each said base member being formed in alignment with said first walls and having a curved recess formed therein for external access thereto, with said base members being configured with said curved recesses formed in general alignment for substantially simultaneously receiving lifting support implements; each said curved recess being defined by a sloping wall portion extending into said base member from a first vertical displacement to a second vertical displacement, said second vertical displacement being closer to said platform than said first vertical displacement, a receiving surface formed by a concave wall portion of said base member and a lifting surface formed as a substantially horizontal wall portion of said base member.

15. A cargo support device according to claim 14 wherein said concave wall portion is formed as a smooth curve having a substantially constant radius.

16. A cargo support device according to claim 14 wherein said cargo support device is molded using a polymer and is formed symmetrically in a manner defining four substantially identical corner structures including four substantially identical base members.

* * * * *